US005119726A

United States Patent [19]

Dörsam

[11] Patent Number: 5,119,726

[45] Date of Patent: Jun. 9, 1992

[54] OSCILLATING FORME ROLLER

[75] Inventor: Willi R. L. Dörsam, Höchberg, Fed. Rep. of Germany

[73] Assignee: Koenig & Bauer Aktiengesellschaft, Wurzburg, Fed. Rep. of Germany

[21] Appl. No.: 576,832

[22] Filed: Sep. 4, 1990

[30] Foreign Application Priority Data

Sep. 20, 1989 [DE] Fed. Rep. of Germany ..... 3931291

[51] Int. Cl.[5] ..... B41F 31/14; B41L 27/16

[52] U.S. Cl. ..... 101/348; 101/DIG. 38

[58] Field of Search ..... 101/348, 349, 350, 351, 101/352, DIG. 38, 148, 207-210

[56] References Cited

FOREIGN PATENT DOCUMENTS 93150 6/1982 Japan ..... 101/DIG. 38

*Primary Examiner*—J. Reed Fisher

*Attorney. Agent, or Firm*—Jones, Tuller & Cooper

[57] ABSTRACT

An oscillating forme roller which is unseable in an inking unit of a rotary printing machine has a rotatable and axially oscillating mantle tube carried on a roller axle. Stops are used at either end of the axle to prevent oscillation of the mantle tube. At least one of these stops is moveable axially to selectively prevent or allow the axial movement of the mantle tube.

5 Claims, 4 Drawing Sheets

OSCILLATING FORME ROLLER

FIELD OF THE INVENTION

The present invention is directed generally to an oscillating forme roller. More particularly, the present invention is directed to an oscillating forme roller for an inking unit of a rotary printing machine. Most specifically, the present invention is directed to an oscillating forme roller for an inking unit with the forme roller being axially shiftable and having stops which are engageable to stop the axial shifting. The stops may include an adjusting device which is rotatable with respect to the axis of rotation of the forme cylinder to limit or to allow axial shifting of the forme cylinder. Adjustable stops may be placed at both ends of the forme cylinder or a single adjustable stop can be located at one end of the cylinder and can cooperate with a fixed stop at the other end of the cylinder.

DESCRIPTION OF THE PRIOR ART

Oscillating forme rollers, which are useable in inking units of rotary printing machines, are generally well known in the art. These oscillating forme rollers are often used to evenly spread or distribute printing ink over the surface of a plate cylinder or printing plates secured to such a plate cylinder. It is frequently desirable to provide forme cylinders which have the capability of being switched between oscillating and non-oscillating modes of operation.

In German Utility Model No. 8330123 there is disclosed an oscillating ink forme roller which moves in a lateral movement with respect to an ink distributing roller from which it is driven by friction. In this device, an outer casing of the oscillating ink forme roller is both rotatably as well as axially shiftably supported on an axle of the roller. This axle is non-rotatably arranged in bearings with the axial stroke of the outer casing being limited by bushings which are situated on both sides of the roller.

In a device such as the oscillating ink forme roller shown in the above-discussed German utility model, the oscillating movement of the outer casing of the forme roller cannot be stopped from functioning. So long as the forme roller is in driving engagement with the distributing roller, it will move in an oscillating manner. In various printing situations, this oscillating movement of the forme roller is not required. In other situations, such oscillating movement may even be detrimental to the printing process.

It will thus be seen that a need exists for an oscillating forme roller in which the oscillating stroke or motion of the roller can be selectively engaged or disengaged. The oscillating forme roller of the present invention provides such a device and is a significant improvement over prior art devices.

SUMMARY OF THE INVENTION

It is an object of the present invention to provide an oscillating forme roller.

Another object of the present invention is to provide an oscillating forme roller for an inking unit of a rotary printing machine.

A further object of the present invention is to provide an oscillating forme roller which is driven by friction.

Yet another object of the present invention is to provide an oscillating forme roller which is rotatably and axially shiftably supported by a non-rotatable roller axle.

Even a further object of the present invention is to provide an oscillating forme roller having an oscillating stroke that can be turned on or off.

Still yet another object of the present invention is to provide an oscillating forme roller which is either manually or automatically turned on or off.

As will be set forth in detail in the description of the preferred embodiment which is presented subsequently, the oscillating forme roller in accordance with the present invention includes a rotatable and axially shiftable mantle tube that is supported on a roller axle. At least one end of the mantle tube is in abutment with an adjusting device that either allows or prevents axial shifting of the mantle tube along the roller axle. In one embodiment, the adjusting device utilizes an adjusting ring which overlies a pair of axially spaced sliding and bearing rings. In a second embodiment, the adjusting device includes a pair of generally opposed pivotable levers which either engage or release a bearing ring carried at one end of the mantle tube. These pivotable levers are actuated by an adjusting ring having an elliptical control surface.

In both preferred embodiments of the oscillating forme roller of the present invention, the oscillating movement of the mantle tube can be selectively turned off. This means that oscillating movement of the forme roller is available when desired and can be locked out when not required. This switching on or switching off of the distributing or oscillating stroke of the forme roller can be accomplished either while the printing machine is in operation or while it is as rest. The person who is effecting the switching on or off of the oscillating roller can do so without having to pay attention to the oscillating rhythm of the forme roller.

The oscillating forme roller of the present invention can easily be employed with generally conventional roller lock-ups. This means that the present forme roller can be employed with printing machines that are already in use, or can be applied at a later date to previously manufactured printing machines.

The oscillating forme roller, particularly in accordance with the second preferred embodiment, can be switched on or off to a centered position with respect to the roller which engages it and drives it. This can be accomplished from one end of the forme roller as opposed to requiring adjustments at both ends of the roller axle.

It will thus be seen that the oscillating forme roller in accordance with the present invention overcomes the limitations of prior art devices and represents a substantial advance in the art.

BRIEF DESCRIPTION OF THE DRAWINGS

While the novel feature of the oscillating forme roller in accordance with the present invention are set forth with particularity in the appended claims, a full and complete understanding of the invention may be afforded by referring to the detailed description of the preferred embodiments, as is set forth subsequently, and as illustrated in the accompanying drawings, in which:

DESCRIPTION OF THE PREFERRED EMBODIMENTS

Figure 2:
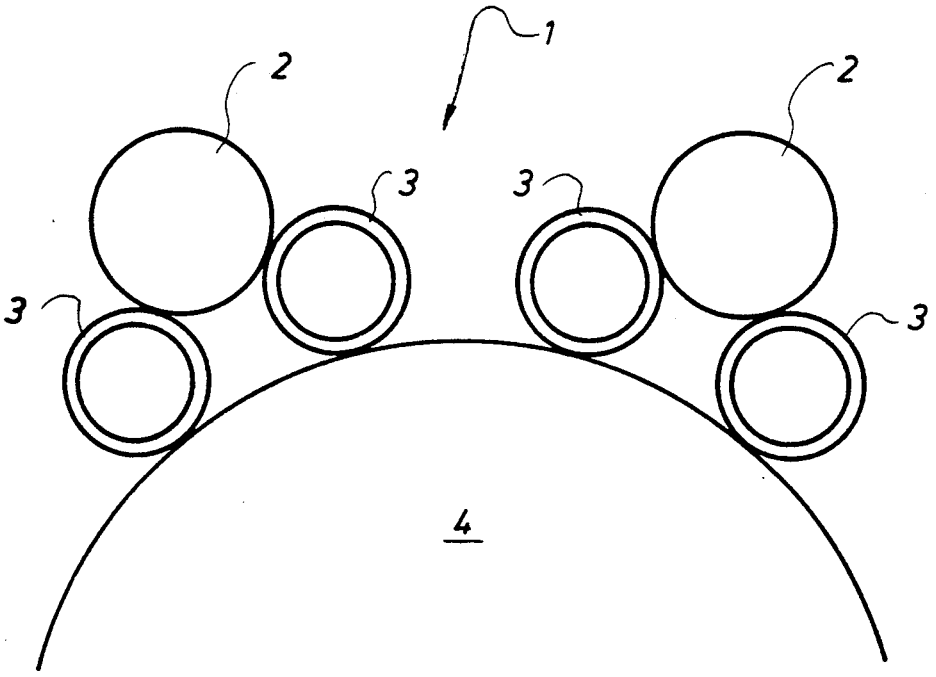
FIG. 2 is a schematic depiction of a portion of an inking unit using the present invention.

Referring initially to FIG. 2, there may be seen, generally at 1, an inking unit of a rotary printing machine. This inking unit 1 includes a number of rotatably supported ink distributing rollers 2 with two such rollers being depicted in FIG. 2. Each ink distributing roller 2 is provided with a generally conventional drive means (not shown) for effecting a lateral movement of the distributing roller 2. Each distributing roller 2 is in frictional contact with several forme rollers 3, with each such forme roller 3 also contacting the surface of a plate cylinder 4 or with various printing plates which are carried on the surface of cylinder 4. Each of the forme rollers 3 is an oscillating forme roller in accordance with the present invention. Since all of these rollers 3 are the same, only one will be discussed hereinafter.

Figure 1:
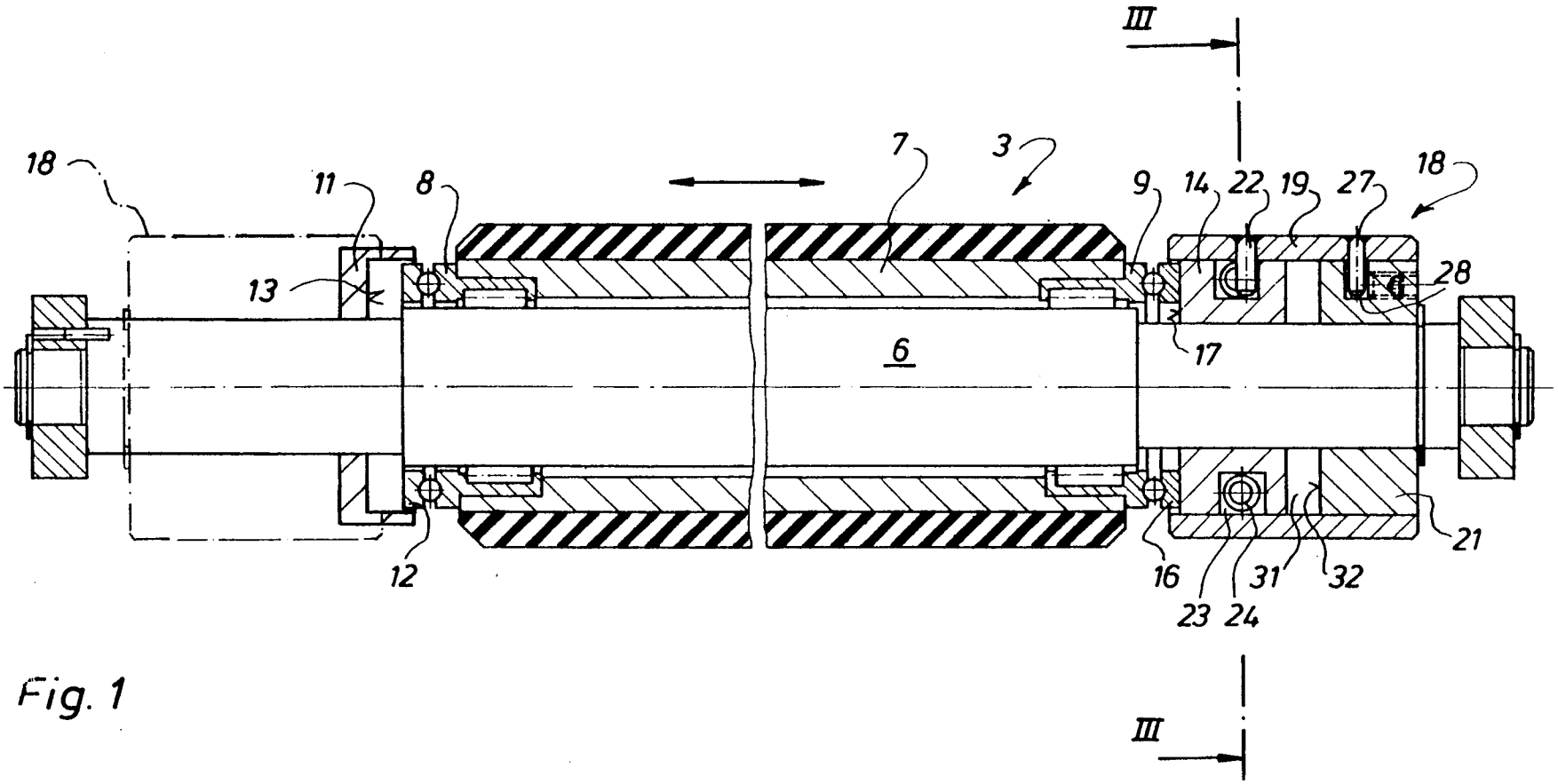
FIG. 1 is a side elevation view, partly in section, of a first preferred embodiment of an oscillating forme roller in accordance with the present invention.

Turning now to FIG. 1, each oscillating forme roller 3, in accordance with both the first and second preferred embodiments, has a roller axis or axle 6 which is supported in suitable roller lock-ups. The roller lock-ups are situated in a generally conventional manner in pivotably supported levers (not shown) so that the contact between the forme rollers 3 and the plate cylinder 4 can be interrupted. On the roller axis 6, a mantle tube 7, having a rubber outer covering, is rotatably and axially shiftably supported by means of two combined radial thrust bearings 8 and 9.

In accordance with the first preferred embodiment of the invention, lateral oscillation of the mantle tube 7 is limited, on the left side of roller 3, by a stop ring 11 which is fixed to the roller axle 6. In this connection, a left or outer bearing ring 12 of the left radial thrust bearing 8 engages a stop area 13 of the stop ring 11. On the right side of roller 3, the axial stroke of about 7 to 8 mm is limited by a sliding ring 14. In this connection, a right or outer bearing ring 16 of the right radial thrust bearing 9 engages a stop area 18 of the sliding ring 14. The sliding ring 14 is rotatably and axially shiftably supported on the roller axis 6 as part of an adjusting device 18 which forms the adjusting assembly in accordance with the first preferred embodiment for shifting on or off the oscillating motion of the forme roller 3.

Figure 3:
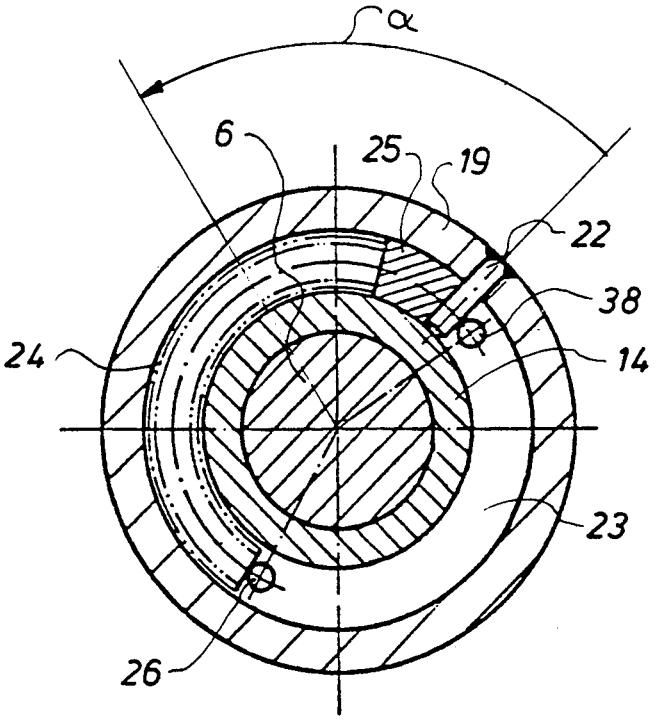
FIG. 3 is a cross-sectional view of the roller of the present invention and taken along lines III—III in FIG. 1.

As may be seen in FIGS. 1 and 3, the adjusting assembly 18 of the first preferred embodiment has the sliding ring 14 and a bearing ring 21. An adjusting ring 19 coaxially surrounds, and is pivotably or rotatably and axially shiftably supported on the sliding ring 14 and the bearing ring 21. The rotating movement of the adjusting ring 19 is limited in the circumferential direction by a first guide pilot 22 which is radially aligned inwards and which is fixed to the adjusting ring 19. The first guide pilot 22 meshes in a circular groove 23 of the sliding ring 14. A spiral spring 24, such as a compression spring, is provided in the circular groove 23 and meshes with the guide pilot 22. One end of spiral spring 24 is affixed over a sliding block 25 and the other end of spring 24 engages a stop 26, such as a bolt which is fixed to the sliding ring 14. The circular groove 23 is sufficiently wide, for example about 10 mm, so that an axial movement of the guide pilot 22 is possible in the circular groove 23.

A second guide pilot 27 is positioned parallel to the first guide pilot 22, is also radially aligned inward, and is also fixed to the adjusting ring 19. The second guide pilot 27 blocks any axial movement of the adjusting ring 19 by meshing in a guiding groove 28 formed in the bearing ring 21. An axial movement of the adjusting ring 19 is only possible in a certain angular orientation between the adjusting ring 19 and the bearing ring 21. In this angular position, the guiding groove 28 has an almost axially running part 30, as may be seen most clearly in FIGS. 4, 5, and 6. It will be understood that in the position of adjusting ring 19 with respect to bearing ring 21 in which the second guide pilot 28 is in the axially running slot 30, that the adjusting ring 19 can move axially with respect to the bearing ring 21.

Figure 6:
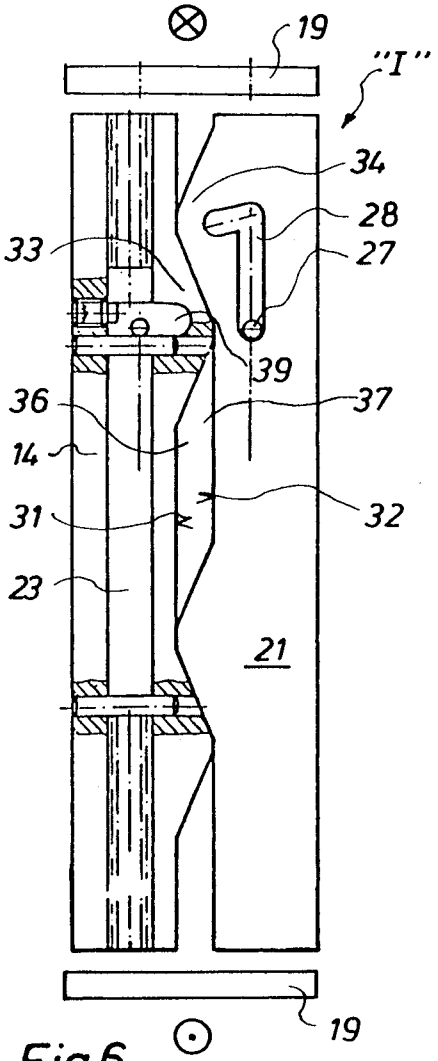
FIGS. 4, 5 and 6 are schematic depictions of the first preferred embodiment of the oscillating adjusting device and showing the assembly in several different positions.
Figure 5:
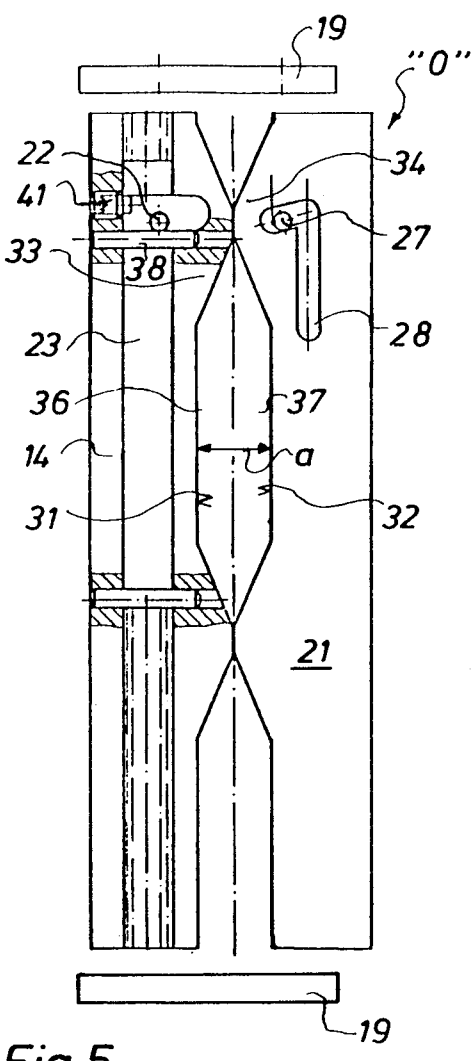
Figure 4:
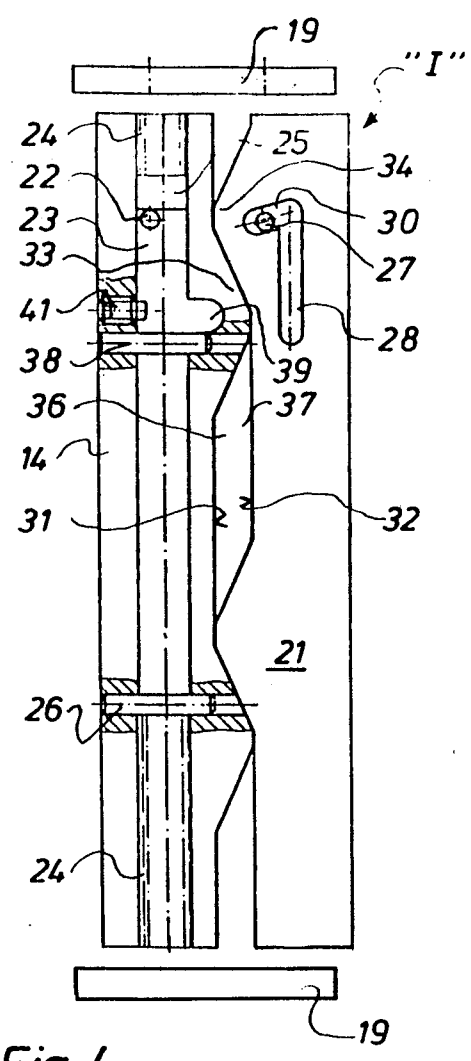

The sliding ring 14 and the bearing ring 21 are arranged next to each other on the roller axis 6 and are in lateral contact with each other through respective control surfaces 31 and 32, as best seen in FIGS. 4–6. In this connection, the control surface 31 of the sliding ring 14 is axially aligned on the right end of sliding ring 14 and the control surface 32 of the bearing ring 21 is axially aligned on the left end of the bearing ring 21. Each of these control surfaces 31 and 32 has a plurality of spaced elevations 33 and 34 respectively, as well as a number of spaced depressions 36 and 37, respectively.

In an oscillating position "I" of the sliding ring 14, as seen in FIGS. 3 and 4, the mantle tube 7 can oscillate on the roller axis 6. In this position, an elevation 33 of the control surface 31 of the sliding ring 14 adjoins a depression 37 of the control surface 32 of the bearing ring 21 and an elevation 34 of the control surface 32 adjoins a depression 36 of the control surface 31. In a switching-off position "0", which is depicted in FIG. 5, an elevation 33 of the control surface 31 adjoins an elevation 34 of the control surface 32. The depressions 36 and 37 of the control surfaces 31 and 32 are at a distance "a" of about 16 mm from each other, which distance "a" is about double the size of the stroke "h" of about 8 mm. In the switching-off position, the bearing rings 12 and 16 of the radial thrust bearings 8 and 9 adjoin the stop area 13 and 17 so that an oscillating movement of the mantle tube 7 is blocked. In this switched-off location, the roller tube 7 is situated outside a central position to the plate cylinder 4. This is because only one adjusting device 18 is depicted in FIG. 1. As is depicted in phantom lines, in FIG. 1, a second similar adjusting device 18 may be positioned on the left end of the roller axle 6. In this case the bearing ring 11 is eliminated. The use of two such adjusting devices 18 would allow the mantle tube 7 to be locked in a switched out position "0" that would locate the mantle tube 7 centrally with respect to its associated plate cylinder 4. It will be understood that if two such adjusting devices 18 were to be used, that the control surfaces 31 and 32 would be altered in shape so that the height differences between the elevations 33 and 34 and the depressions 36 and 37 would be essentially one half of that shown in FIGS. 4–6. If there was provided two such adjusting devices 18, it will be understood that a suitable linkage assembly, such as a coaxial tube or the like, could be provided so that both adjusting devices 18 could be operated to effect a switching on or switching off procedure from one side of the machine. It will further be understood that the adjusting ring or rings 19 could be provided with any suitable adjusting drive assembly so that an automatic, remote adjustment of the adjusting device 18 could be accomplished.

To change the sliding ring 14 and the mantle tube 7 from the oscillating position "I" to the switching-off position "0", the adjusting ring 19 has to first be twisted or rotated through an angle $\alpha$ of generally about 45° and then be shifted for a short distance of about 5 mm to the left as seen in FIGS. 4 and 5. In doing this, the second guide pilot 27 slides upwards in the guiding groove 28 and aligns with the axially running part 30 of the groove 28. Concurrently with movement of the second pilot 27, the first guiding pilot 22 slides upwards in its circular groove 23 and takes the sliding block 25 and the spiral spring 24 which supports itself on it with it. When the bearing ring 16 is situated at a distance from the stop area !7, the spring 24 has an effect upon the stop 26, without any considerable initial tension, and twists the sliding ring !4. In doing this, the sliding ring 14 supports itself with its control surface 31 on the control surface 32 of the bearing ring 21 and is thus axially shifted to the left into the switching-off position "0" which is depicted in FIG. 5. When the bearing ring 16 is in contact with the stop area 17, rotation of the adjusting ring 19 causes the spring 24 to be compressed or preloaded as depicted in FIG. 3. Rotation of ring 19 thus shifts the pilot guide 22 to the left side of the circular groove 23 because of the axial movement of the adjusting ring 19. Being now under the force of the initial tension of the spiral spring 24, the sliding ring 14 strives to accomplish a rotational movement and to shift over the control surfaces 31 and 32 axially to the left. Therefore, the stop area 17 of the sliding ring 14 follows the bearing ring 16 on the mantle tube 7 when this moves to the left under the action of the distributing roller 2 and then locks the mantle tube 7 in the switching-off position "0" when the elevation 33 moves and adjoins the elevation 34 of the control surfaces 31 and 32, again as depicted in FIG. 5.

When the mantle tube 7 is to be brought from the switching-off position "0" to the oscillating position "I", the adjustment ring 19 is at first axially shifted to the right and then rotated back by the angle $\alpha$. In doing this, the first guide pilot 22 first shifts into an axially extending part 39 of the circular groove 23 and takes the sliding ring 14 with it. When the adjusting ring 19 then rotates, the first guide pilot 21 contacts a bolt 38, which is fixed to the sliding ring 14, and rotates ring 14 until the elevation 33 adjoins the depression 37 and the elevation 34 adjoins the depression 36. A stop 41 projects into the circular groove 23 and prevents the sliding block 25 from obstructing the circular groove 23 in the area of the part 39.

Figure 7:
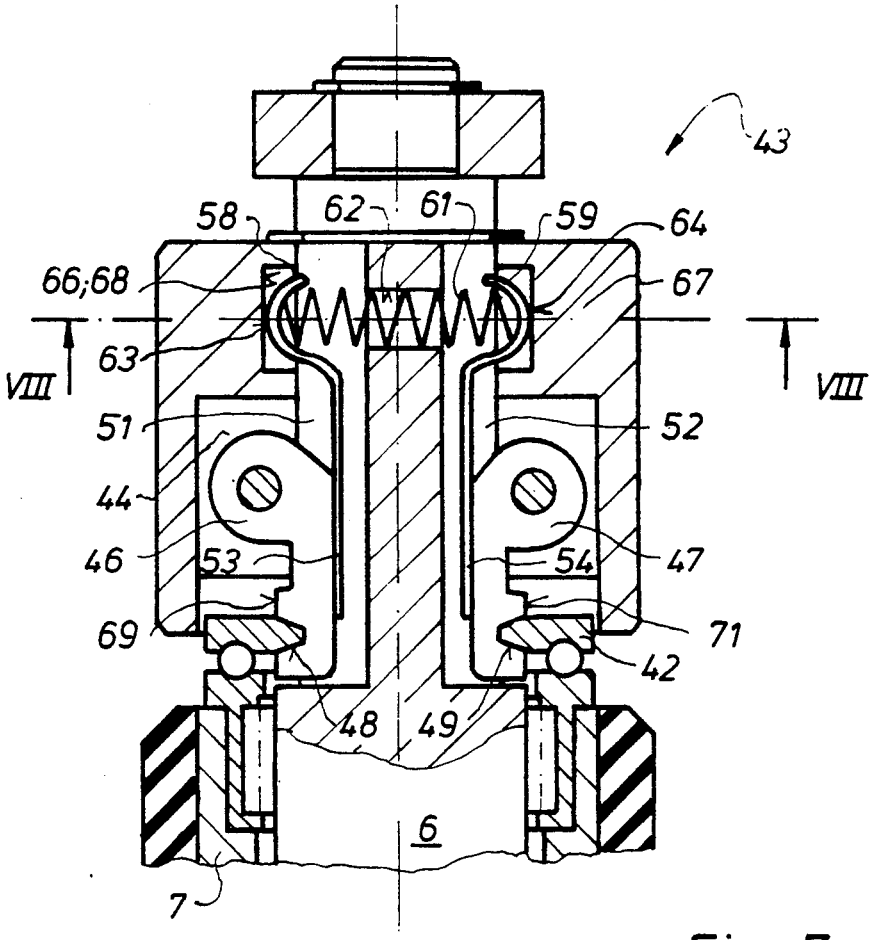
FIG. 7 is a sectional view of an end of a second preferred embodiment of an oscillating forme roller in accordance with the present invention and showing a second adjusting assembly.
Figure 8:
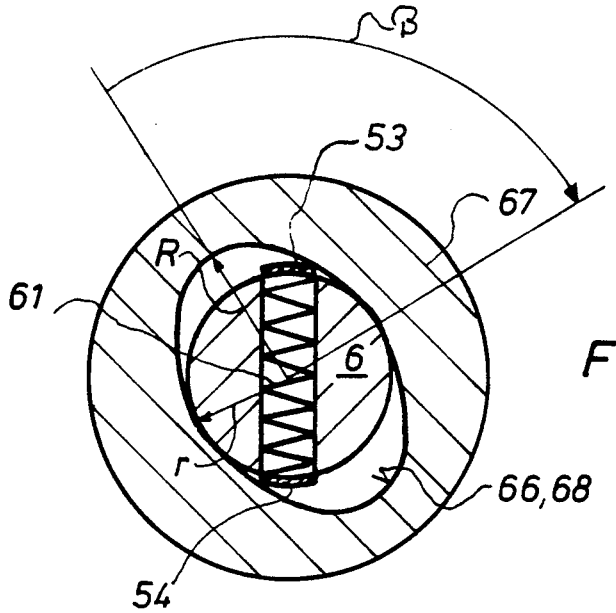
FIG. 8 is a cross-sectional view of the adjusting assembly of the second preferred embodiment and taken along line VIII—VIII of FIG. 7.

Turning now to FIGS. 7 and 8, there is shown a second preferred embodiment of an oscillating forme roller in accordance with the present invention. It will be understood that only the right end of the forme roller is depicted in FIG. 7 and that the overall structures of the roller axle 6 and mantle tube 7 are generally the same in both of these preferred embodiments. In this second preferred embodiment, a second adjusting device 43 is provided for use to detachably secure the mantle tube 7 in a central position with respect to the plate cylinder 4 and to effect the switching on and switching off of the oscillating movement.

A bearing ring 44 is carried on the roller axle 6, as is shown in FIG. 7. Bearing ring 44 does not slide axially along roller axle 6 and also does not rotate with mantle tube 7. A pair of radially pivotably levers 46 and 47 are pivotably secured to the bearing ring 44, with each lever 46 and 47 having at its end a groove 48 or 49 which faces radially outward for receiving a bearing ring 42. A trough 51 or 52 in the roller axis 6 makes the pivoting movement of the levers 46 and 47 possible. Each of the levers 46 and 47 has a plate spring 53 and 54, respectively on its radially inner side. Each such plate spring 53 or 54 tends to bias its associated lever 46 or 47 radially outwardly.

Plate springs 53, 54 are aligned generally parallel to the axis of roller axle 6 and project up to an adjusting ring 67 within the troughs 51 and 52. Ends 58 and 59 of plate springs 53 and 54 are semi-circularly bent respectively so that an opening of each semi-circle faces radially inwardly. A compression spring 61 is positioned in a radial borehole 62 in the roller axis 6 and its ends are received in the semi-circular ends 58 and 59 of the plate springs 53 and 54 with a small initial tension. The ends 58 and 59 of the plate springs 53 and 54 contact, with their sides 63 and 64 which are radially aligned outwards, an inner surface 66 of the adjusting ring 67. The adjusting ring 67 is rotatably supported on the roller axis 6. As may be seen most clearly in FIG. 8., the inner surface 66 has an elliptical control contour surface 68. During oscillating movement of the forme roller 3, the ends of the plate springs 58 and 59 contact the portion of the control contour 68 which has the larger radius R under the force of the compression spring 61. In this configuration, the levers 46 and 47 are radially pivoted inwardly so that they do not engage or contact the bearing ring 42 which is affixed to the mantle tube 7 of the forme roller 3.

To switch off the oscillating movement of the forme roller 3, the adjusting ring 67 is rotated through an angle $\beta$ of between 45° to about 90°. In doing this rotation of ring 67, the ends 58 and 59 of the plate springs 53 and 54 move into an area of the control contour 68 which has a smaller radius "r" so that the compression spring 61 is compressed. This compression of the compression spring 61 and the accompanying radial inward movement of the ends 58 and 59 of the plate springs 53 and 54 causes the opposite ends of the pivotable levers 46 and 47 to be pivoted radially outwardly. If the forme roller 3, and specifically the axially slidable mantle tube 7 is not in a central position at this moment, the bearing ring 42 slides on the surfaces 69 and 71 of the levers 46 and 47, which border the grooves 48 and 49. The levers 46 and 47 remain in place on the bearing ring 42 by means of the preloaded plate springs 53, 54 until ring 42 has reached its central position. At this moment, the levers 46 and 47 pivot outwards until the bearing ring 42 is wedged in the grooves 48 and 49. The grooves 48 and 49 are trapezoidally shaped correspondingly with the bearing ring 42 so that the grooves 48 and 49 can mesh with the bearing ring 42 without clearance. The inclination of the side walls of the grooves 48 and 49 is such that the bearing ring 42 cannot press the levers radially inwards due to a lateral component force on the mantle tube 7 caused by contact with the distributing roller 2.

To switch on the oscillating movement of the mantle tube 7, the adjusting ring 67 is rotated back by the angle $\beta$. This can either be accomplished manually or, when adjusting drives are provided, by remote control or automatically. Upon rotation of ring 67, the sides 63 and 64 of the plate spring ends 58 and 59 slide on the control contour 68 back into the area of the large radius R. The tension is thus released from the compression spring 61 and the relaxed compression spring allows the levers 46 and 47 to pivot, by means of the plate springs 53 and 54, into the troughs 51 and 52. The bearing ring 42 disengages from the grooves 48 and 49 so that the forme roller 3 between the bearing ring 11 and the bearing ring 44 can freely oscillate.

While first and second preferred embodiments of an oscillating forme roller in accordance with the present invention have been set forth fully and completely hereinabove, it will be apparent to one of skill in the art that a number of changes in, for example the number of forme roller used, the type of covering on the mantle tube, the type of radial thrust bearings, and the drive means for the ink distributing roller and the like, may be made without departing from the true spirit and scope of the present invention which is accordingly to be limited only by the following claims.

What is claimed is:

1. An oscillating forme roller useable in an inking unit of a rotary printing machine, said oscillating forme roller comprising:

a forme roller axle mounted in the rotary printing machine;

a mantle tube supported on said forme roller axle for rotation and axial movement with respect to said forme roller axle;

a first stop means positioned on said roller axle and engageable with a first end of said mantle tube;

a second stop means positioned on said roller axle and engageable with a second end of said mantle tube;

means for moving at least one of said first and second stop means between a first position wherein said mantle tube can shift axially and a second position wherein said mantle tube is prevented from shifting axially; and at least one of said first and second stop means including a stop ring which is engageable with a corresponding one of said first and second ends of said mantle tube and which is slidably and rotatably supported on said roller axle, a bearing ring which is secured on said roller axle, and an adjusting ring which overlies and contacts said stop ring and said bearing ring and which is rotatable and axially slidable with respect to said stop ring and said bearing ring to effect shifting of said stop ring with respect to said bearing ring.

2. The oscillating forme roller of claim 1 wherein said stop ring has a first control surface and further wherein said bearing ring has a second control surface, said first and second control surfaces being positioned axially adjacent and in contact

3. The oscillating forme roller of claim 2 wherein said first control surface has spaced axially extending elevations and depressions and further wherein said second control surface has spaced axially extending elevations and depressions, said elevations and depressions on said first control surface facing said elevations and depressions on said second control surface.

4. The oscillating forme roller of claim 1 wherein said stop ring has a circumferential groove on an outer peripheral surface thereof and further wherein a spiral spring is positioned in said groove, said spiral spring being joined to said stop ring and to said adjusting ring to transmit rotation movement of said adjusting ring to said stop ring.

5. The oscillating forme roller of claim 4 wherein a first guide pin is attached to said adjusting ring and engages said spiral spring in said groove.

* * * * *